US005665034A

United States Patent [19]

Hwang

[11] Patent Number: 5,665,034

[45] Date of Patent: Sep. 9, 1997

[54] EXERCISE MECHANISM FOR SIMULATING ROWING TYPE EXERCISES

[76] Inventor: Hong-Long Hwang, No. 210 Ming-Shan St., He-Ming Village, Shiou-Shuei Hsiang, Jang-hua County, Taiwan

[21] Appl. No.: 588,936

[22] Filed: Jan. 19, 1996

[51] Int. Cl.[6] ..... A63B 21/00

[52] U.S. Cl. ..... 482/72; 482/112

[58] Field of Search ..... 482/137, 72, 111, 482/112, 138, 142, 73, 136

[56] References Cited

U.S. PATENT DOCUMENTS 4,723,774 2/1988 Monforte ..... 481/72
5,423,731 6/1995 Chen ..... 482/72
5,441,469 8/1995 Chern ..... 482/72
5,503,608 4/1996 Chang ..... 482/72

*Primary Examiner*—Jerome Donnelly
*Attorney, Agent, or Firm*—Morton J. Rosenberg; David I. Klein

[57] ABSTRACT

An exercise mechanism includes a seat cushion secured on a base which includes two posts secured to the side portions by fastening screws. A pair of handles each has a lower portion pivotally coupled to the post at a pivot shaft. A pair of resistive members each has a lower end secured to the post and each has an upper end pivotally coupled to the handles such that the handles can be rotated about the pivot shafts against the resistive members. The, handles and the resistive members are secured to the posts and rotated in concert with the posts before the securing members secure the posts to the base.

2 Claims, 4 Drawing Sheets

EXERCISE MECHANISM FOR SIMULATING ROWING TYPE EXERCISES

BACKGROUND OF THE INVENTION

1. Field of the Invention

The present invention relates to an exercise mechanism, and more particularly to an exercise mechanism for simulating rowing type exercises.

2. Description of the Prior Art

Typical rowing type exercise mechanisms comprise a pair of handles that may be rotated forward and rearward so as to simulate rowing type exercises. However, the typical rowing type exercise mechanisms may not change the handles so as to rotate the handles sidewise.

The present invention has arisen to mitigate and/or obviate the afore-described disadvantages of the conventional rowing type exercise mechanisms.

SUMMARY OF THE INVENTION

The primary objective of the present invention is to provide an exercise mechanism which includes a pair of handles that may be changed and rotated for an angle so as to allow the handles to be rotated in different directions.

In accordance with one aspect of the invention, there is provided an exercise mechanism comprising a base including a seat cushion secured thereon for supporting a user, the base including two side portions each having a hole formed therein, a pair of posts each including a lower end for engaging with the holes of the base and each including an upper end, means for securing the posts to the base, a pair of handles each including a lower portion pivotally coupled to the upper end of the post at a pivot shaft so as to allow the handles to be rotated about the pivot shafts, and a pair of resistive means each including a lower end secured to the post and each including an upper end pivotally coupled to the lower portion of the handles at a pivot axle, so as to allow the handles to be rotated about the pivot shafts against the resistive means. The handles and the resistive means are secured to the posts and rotated in concert with the posts before the securing means secures the posts to the base.

The base includes a front portion having an extension extended therefrom, the exercise mechanism further comprises a lever including a middle portion pivotally coupled to the extension, the lever includes an upper portion and a lower portion each having a foot support means secured thereto, the lever includes a rod secured to the middle portion thereof, and a weight means is secured to the rod for resisting a rotational movement of the lever.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
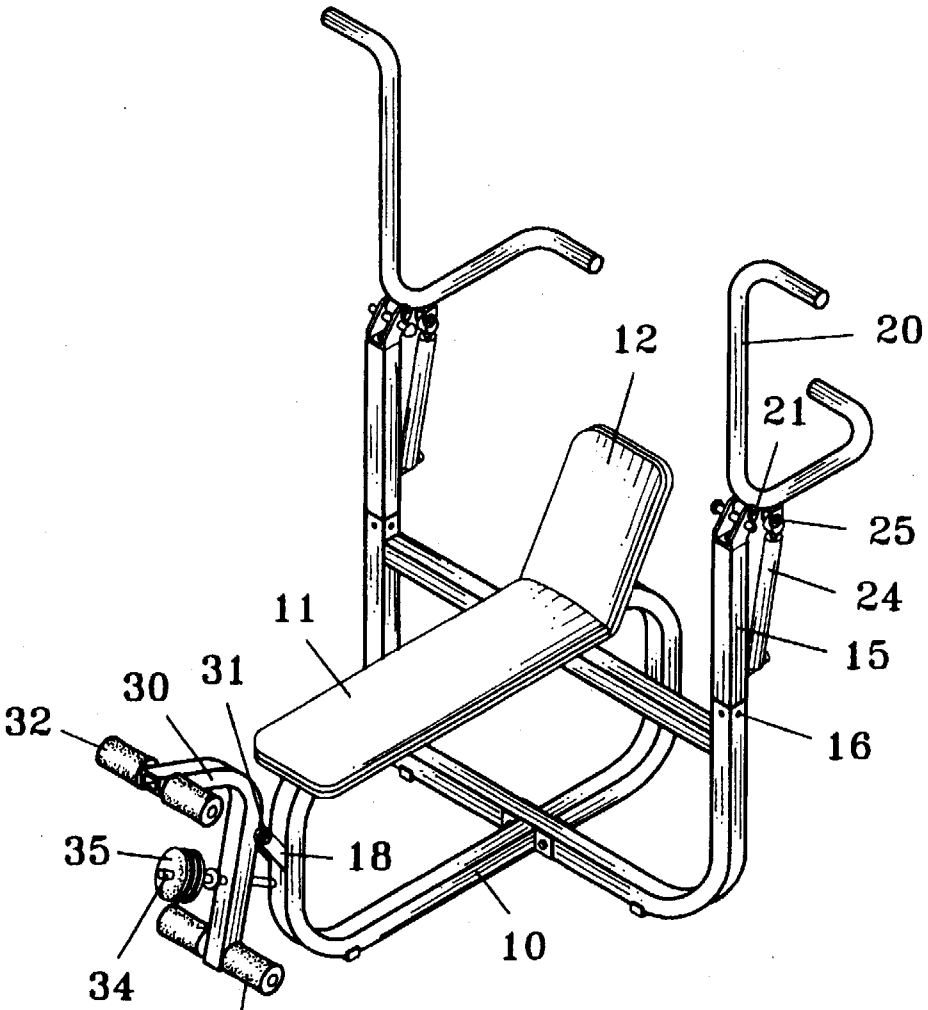
FIG. 1 is a perspective view of an exercise mechanism in accordance with the present invention.
Figure 2:
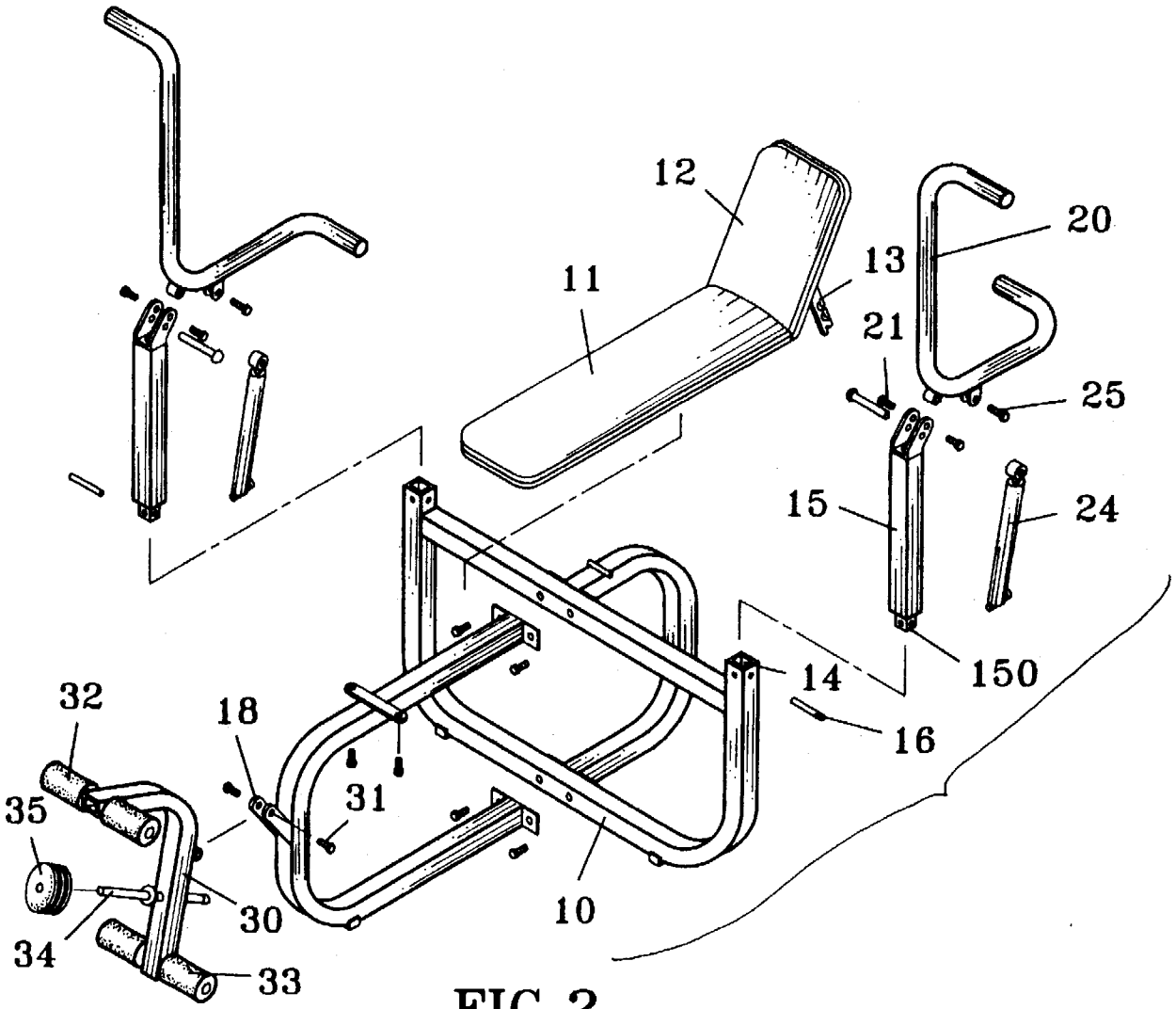
FIG. 2 is an exploded view of the exercise mechanism.

Referring to the drawings, and initially to FIGS. 1 and 2, an exercise mechanism in accordance with the present invention comprises a base 10 including a seat cushion 11 secured thereon for supporting a user thereon. The seat cushion 11 includes a back support 12 secured thereto and supported on the base 10 by a stay 13. The base 10 includes two side portions each having a hole 14 formed therein for receiving a lower end 150 of a post 15 which is secured to the side portions of the base 10 by fastening screws 16.

A pair of handles 20 each includes a lower portion pivotally coupled to the top portion of the respective post 15 by a pivot shaft 21. A pair of actuators or resistive members 24 each includes a lower end secured to the post 15 and each includes an upper end pivotally coupled to the lower portion of the handles 20 at a pivot axle 25. The handles 20 may be rotated about the respective pivot shafts 21 by the users in order to overcome the resistive forces of the resistive members 24 and so as to conduct rowing type exercises.

The base 10 includes an extension 18 extended therefrom for pivotally coupling the middle portion of a lever 30. The lever 30 includes an upper portion and a lower portion each having a pair of feet supports 32, 33 secured thereto for engaging with the feet of the user. The lever 30 includes a middle portion having a rod 34 secured thereto for securing a weight member 35 thereto. The user may use their feet to rotate the lever 30 in order to overcome the weight of the weight member 35 so as to exercise the leg muscles.

Figure 3:
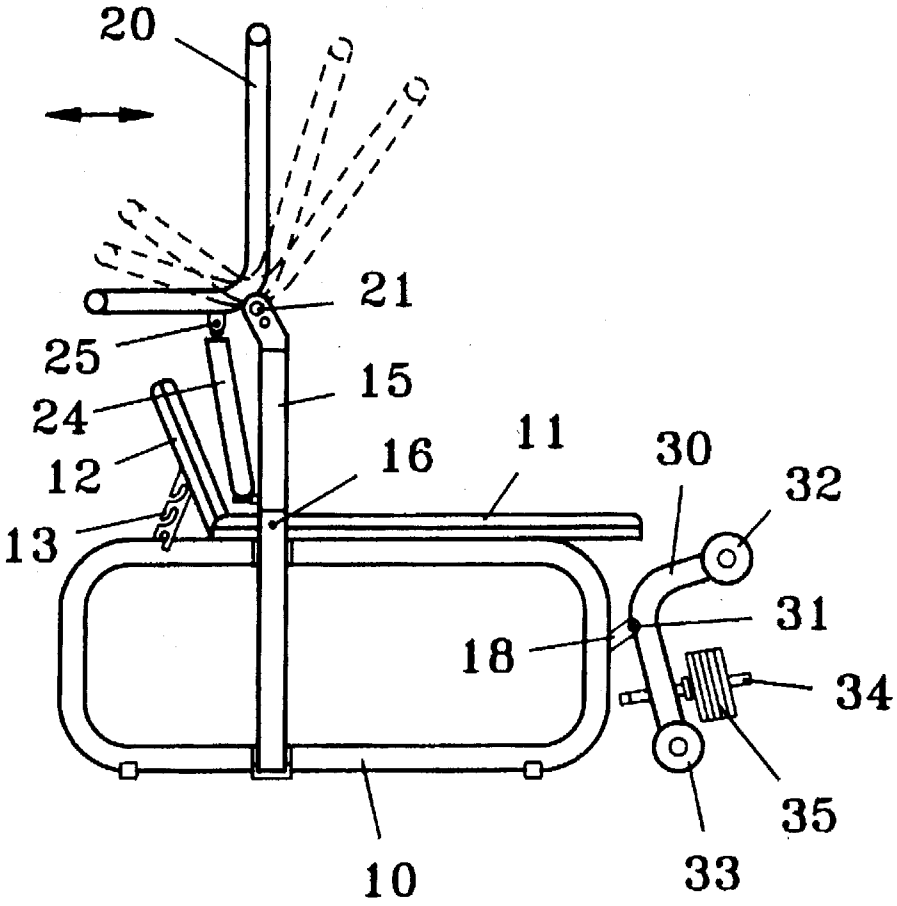
FIG. 3 is a side elevational view of the exercise mechanism.

Referring next to FIG. 3, the handles 20 may be rotated forward and rearward about the pivot shafts 21 by the user in order to overcome the resistive forces of the resistive members 24 and so as to conduct rowing type exercises.

Figure 4:
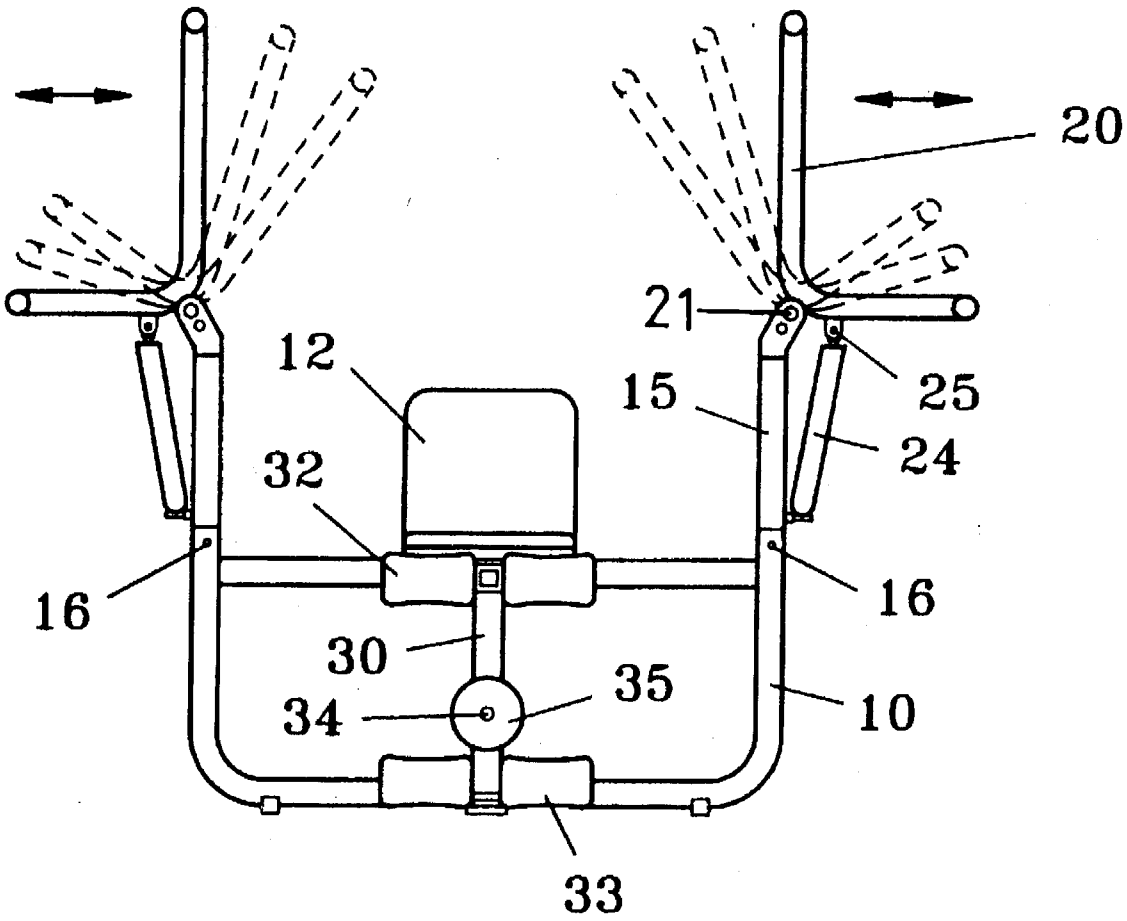
FIG. 4 is a front view of the exercise mechanism.

Referring next to FIG. 4, the posts 15 may be disengaged from the base 10 when the fastening screws 16 are disengaged from the base 10. The posts 15 may then be rotated for 90 degrees and engaged in the holes 14 of the base 10 again and secured to the base 10 by the fastening screws 16 such that the handles 20 may be rotated sidewise about the pivot shafts 21 by the user in order to overcome the resistive forces of the resistive members 24 and so as to conduct sidewise rowing type exercises. It is to be noted that the resistive members 24 and the handles 20 are secured to the posts 15 such that the handles 20 and the resistive members 24 may be easily rotated along with the posts 15 and such that the rotating directions of the handles 20 may be easily changed.

Accordingly, the exercise mechanism in accordance with the present invention includes a pair of posts which may be easily adjusted to different direction so as to adjust the operational direction of the handles.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercise mechanism comprising:

a base including a seat cushion secured thereon for supporting a user, said base including two side portions each having a hole formed therein, a pair of posts each including a lower end for engaging with said holes of said base and each including an upper end, means for securing said posts to said base, a pair of handles each including a lower portion pivotally coupled to said upper end of said post at a pivot shaft so as to allow said handles to be rotated about said pivot shafts, and a pair of resistive means each including a lower end secured to said post and each including an upper end pivotally coupled to said lower portion of said handles at a pivot axle, so as to allow said handles to be rotated about said pivot shafts against said resistive means, said handles and said resistive means being secured to said posts and being rotated in concert with said posts before said securing means secures said posts to said base.

2. An exercise mechanism according to claim 1, wherein said base includes a front portion having an extension extended therefrom, said exercise mechanism further comprises a lever including a middle portion pivotally coupled to said extension, said lever includes an upper portion and a lower portion each having a foot support means secured thereto, said lever includes a rod secured to said middle portion thereof, and a weight means is secured to said rod for resisting a rotational movement of said lever.

* * * * *